United States Patent [19]

Barlian et al.

[11] Patent Number: 4,692,570

[45] Date of Patent: Sep. 8, 1987

[54] ELECTRIC SWITCH

[75] Inventors: Reinhold Barlian, Dieselstr. 6, 6990 Bad Mergentheim; Martin Fischle, Bad Mergentheim; Karl-Heinz Lux, Weikersheim, all of Fed. Rep. of Germany

[73] Assignee: Reinhold Barlian, Bad Mergentheim, Fed. Rep. of Germany

[21] Appl. No.: 746,974

[22] Filed: Jun. 20, 1985

[30] Foreign Application Priority Data

Jun. 22, 1984 [DE] Fed. Rep. of Germany ..... 3423177

[51] Int. Cl.[4] ..... H01H 9/00

[52] U.S. Cl. ..... 200/4; 200/5 R; 200/17 R; 200/153 L

[58] Field of Search ..... 200/1 B, 4, 5 R, 17 R, 200/18, 153 T, 302.1, 302.2, 329–332, 340, 5 B–5 E, 16 A, 47, 50 C, 153 L, 153 LA; 361/346, 350, 351, 353, 354

[56] References Cited

U.S. PATENT DOCUMENTS

| | | | |
|---|---|---|---|
| 2,875,287 | 2/1959 | Van Sickle | 200/153 T X |
| 3,142,732 | 7/1964 | Clarke et al. | 200/50 C |
| 3,170,995 | 2/1965 | Mullen | 200/4 |
| 4,000,382 | 12/1976 | Kolb | 200/4 |
| 4,168,408 | 9/1979 | Yamane | 200/153 T X |
| 4,459,441 | 7/1984 | Hermle et al. | 361/351 X |
| 4,544,815 | 10/1985 | Portmann | 200/16 A X |
| 4,556,768 | 12/1985 | Atsumi et al. | 200/302.2 |

FOREIGN PATENT DOCUMENTS 3423177 8/1985 Fed. Rep. of Germany .

*Primary Examiner*—J. R. Scott
*Attorney, Agent, or Firm*—Horst M. Kasper

[57] ABSTRACT

An electric switch is provided with a support frame at which several key switch elements are individually clipped on. An actuating front piece is attached at the support frame, which is mounted at a front plate of a switching cabinet or the like. A transmission apparatus with a compression spring is provided between a pressure pin of the actuating front piece and a ram of the key switching elements. The compression spring, the ram and the pressure pin are disposed in an inner space of the support frame receiving the key switching elements. The transmission apparatus provides several individual thrust journals which are resting in the base body and which are moved against the force of the individually coordinated overthrow springs for actuating the key switch elements against the ram.

13 Claims, 11 Drawing Figures

ELECTRIC SWITCH

BACKGROUND OF THE INVENTION

1. Field of the Invention

The present invention relates to an electric switch, where snap-in or key switching elements can be individually snapped onto a support frame, where an actuating front attachment is mountable to a front plate and attachable at the support frame and where a transmission means is disposed between a pressure pin of the actuating front attachment and rams of the key switching elements.

2. Brief Description of the Background of the Invention Including Prior Art

The German Patent Application Laid-Open DE-OS No. 2,825,686 teaches an electric switch of the kind under consideration, and this switch comprises key switching elements positioned at a distance relative to each other at a support frame on the two sides of a downwardly protruding middle web, where the web is provided with clamping terminals for electric conductors. A recess is disposed toward the actuating front attachment via the center web of the support frame, and the recess includes upwardly directed web protrusions for receiving a lamp socket as well as the the support frame, and transmission parts.

SUMMARY OF THE INVENTION

1. Purposes of the Invention

It is an object of the invention to provide an electric switch, where in the surrounding regions of the key switching elements are covered and where for each switching key element a separately telescopable transmission arrangement is achieved at the side toward these key switching elements within the support frame.

It is another object of the invention to provide an electric switch which operates safely and reliably.

It is a further object of the invention to provide an electric switch where several contacts can be achieved successively by actuation of a single key switching element.

These and other objects and advantages of the present invention will become evident from the description which follows.

2. Brief Description of the Invention

The present invention provides an electric switch comprising a support frame, key switching elements disposed in an inner space of the support frame and individually attachable to the support frame, a compression spring, a base body movable by a pressure pin against the force of the compression spring, a bow spring, an actuating front attachment mountable to a front plate and supported by the bow spring, two telescoping thrust journals joined to the transmission means and supported by the base body, two overthrow springs individually disposed at a corresponding thrust journal, rams associated to the key switching element and coordinated to the corresponding telescoping thrust journal via the overthrow springs, and transmissions means disposed in the inner space of the support frame below the plane of the bow spring and between a pressure pin of the actuating front attachment and the rams of the key switching elements, where the two thrust journals are joined to the transmission means.

The electric switch can further comprise a guide frame supporting the base body with the telescopic thrust journal, where a bottom wall of the guide frame can be provided with break-outs for the thrust journals movable against the rams and where side walls of the guide frame can be snapped in with clip noses between attachment walls in the inner space of the support frame.

The thrust journals of the transmission means can be formed substantially like a pot, and the overthrow springs can be supported in the pot spaces of the thrust journals and at bottom walls of the thrust journals.

Guide sleeves can be formed at the base body for axially slidably supporting the thrust journals of the tranmission means, and the thrust journals with their pot wall parts can grip over stop edges of the guide sleeves with protrusions formed at the edge regions of the pot wall disposed relatively remote from the floor wall.

The overthrow springs of the thrust journals can be centeredly supported at axle journals of the guide sleeves.

The lengths of the thrust journals disposed at a distance next to each other at the base body can be equal for parallel actuation of the rams of the key switching elements disposed in a plane.

The lengths of the thrust journals disposed at a distance next to each other at the base body can be different for sequential actuation of the rams of the key switching elements disposed in a plane.

The compression spring of the transmission means can be centeredly supported versus the bottom wall of the guide frame at the middle guide sleeve of the base body between two side guide sleeves.

The base body of the transmission means can be provided with two base body parts separated from each other with in each case at least a guide sleeve and in each case a thrust journal, and each of the two parts of the base body can have coordinated to it an individual compression spring supported at a central pin of the guide frame.

The thrust journal can be furnished with a stop pin extending from the bottom wall in the direction toward the axle pin of the guide sleeve to provide a force independent force switching via the ram of the key switching element.

The base body of the transmission means can be provided with a recess at the side opposite to the middle guide sleeve and disposed toward the pressure pin of the actuating front attachment.

The guide sleeves of the base body can be disposed at a distance next to each other and can be located in each case in a plane between two spring tongues of the support frame with the thrust journals. In each case, a key switching element with snap-in noses engages into snap-in recess beads at two outside surfaces.

The key switching elements can be provided with inclined running insertion bevels relative to the axis of the thrust journal at the outside surfaces furnished with the snap-in recess beads, and the insertion bevels can be covered by the spring tongues of the support frame.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

Figure 1:
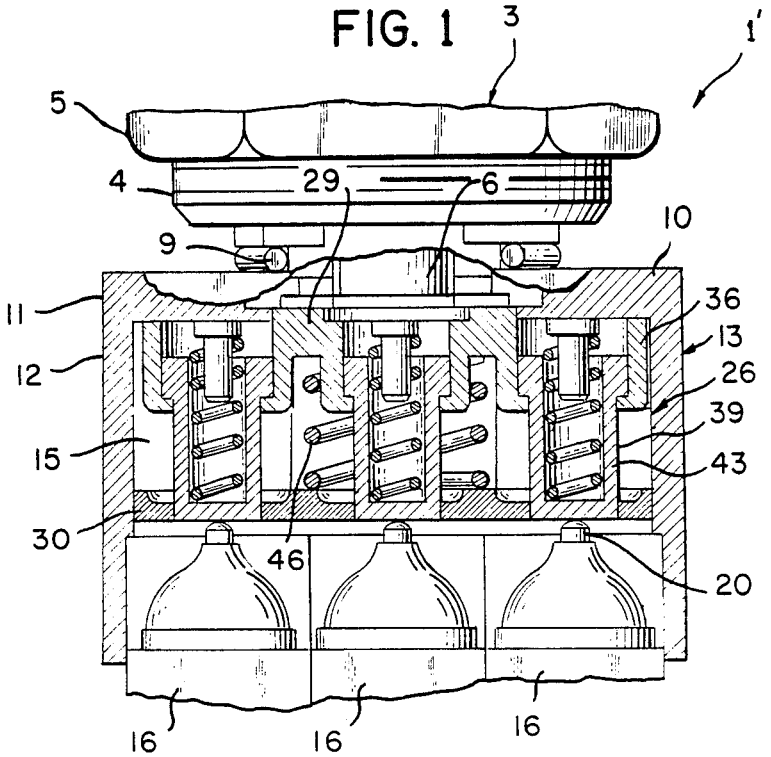
FIG. 1 is a partial sectional view of an electric switch according to the invention with three equally formed telescopable thrust journals in rest position.

In accordance with the present invention, there is provided an electric switch with snap-in or key switching elements which can be individually snapped onto a support frame, actuating front attachments attachable at the support frame and mountable to a front plate and a transmission arrangement disposed between a pressure pin of the actuating front attachment and a ram of the key switching elements together with a compression spring. The transmission arrangement 26 can be disposed in an inner space 15 of the support frame, which inner space also contains the key switching elements 16, and the transmission arrangement is located below the plane of a bow spring 9 supporting the actuating front attachment 3. At least two thrust journals 39 are provided, which are supported at a base body 29 movable against the force of the compression spring 46 by the pressure pin 6. In each case, individually coordinated overthrow springs 43 are provided relative to at least two of these thrust journals 39, and each ram 20 of the key switching elements 16 is coordinated to a thrust journal 39 individually telescopable via the overthrow springs 43.

The base body 29 can be supported with the telescopable via the overthrow springs 43.

The base body 29 can be supported with the telescopable thrust journals 39 in a guide frame 30. The lower wall 34 of the guide frame 30 can be provided with break outs 35 for the thrust journals 39 which are movable against the ram 20. The side walls 32 of the guide frame 30 can be provided with clip-noses 33 which are snapped in between the catchment of the walls 27, 28 in the inner space 15 of the support frame 11.

The thrust journals 39 of the transmission arrangement 26 can be provided substantially formed like a pot, and the overthrow springs or last column springs 43 can be supported in the pot spaces 42 of the thrust journals 39 and can be supported at the bottom walls 41 of the thrust journals 39.

The thrust journals 39 of the transmission means 26 can be supported axially shiftable with guide sleeves 36 formed with pot wall parts 40 in the base body 29. The transmission means can grip over protrusions 44 of the stop edges 38 of the guide sleeves 36 with edge regions disposed remote at the bottom wall 41. The overthrow springs 43 of the thrust journals 39 can be supported at the axle journal 37 of the guide sleeves 36 in centered position.

The thrust journals 39 are placed next to each other at equal distances in the base body 29 can be of equal length for simultaneous parallel actuation of the rams 20 of the key switching elements 16 disposed in a plane.

Alternatively, in order to provide a sequential actuation of the rams 20 disposed in a plane of the key switching elements 16, the thrust journals 39 disposed next to each other at a distance in the base body 29 can be provided of different length.

The compression spring 46 of the transmission arrangement 26 can be disposed in the center position versus the lower wall 34 of the guide frame 30 at the centered guide sleeve 36 of the base body 29 between two side guide sleeves 36.

The base body 29 of the transmission arrangement 26 can be provided with two base body parts 47, 48 separated from each other by in each case a guide sleeve 36 and in each case a thrust journal 39. Each of the two base body parts 47, 48 can be coordinated with an individual compression spring 50 supported on a center shaft 49 of the guide frame 30.

A spring force independent forced switching via the ram 20 of the key switching element 16 of the thrust journals can be provided with a stop pin 51 extending in the direction toward the axial pin 37 of the guide sleeve 36 from the floor wall 41.

The base body 29 of the transmission arrangement 26 can be provided at the center guide sleeve 36 at the side disposed oppositely to the center guide sleeve 36 with a recess 45 located toward the pressure pin 6 of the actuating front attachment 3.

The guide sleeves 36 of the base body 29 which are disposed next to each other at a distance, are disposed with the thrust journals 39 in each case between two spring tongues 14 of the support frame 11 in a plane. The two spring tongues 14 in each case surround a key switching element 16 with the plunger beads 23 with snap-in noses 24 engaging plunger beads 23 at two outsides.

The key switching elements 16 can be provided with inclined running insertion bevels 25 provided at the outsides with the snap-in recess beads 23 relative to the axis of the thrust journal 39. The insertion bevels 25 can be covered by the spring tongues 14 of the support frame 11.

The electric switch 1 illustrated in the drawing is provided for attachment at a front plate 2 (FIGS. 9 and 10) of a switching cabinet or the like, and it is provided with an actuating front attachment 3 which is attached with a screw nut 5 at the front plate 2, where the screw nut 5 grasps with a threaded stud 4. The actuating front attachment 3 can be provided as a pressure key, a throw switch, a key switch, a rotary switch, an illuminated switch, a flip switch or the like, which can be applied as desired. The actuating front attachment 3 is provided with a pressure pin 6 which can be moved, for example, against the force of a spring not shown here axially out of the threaded stud 4. An attachment disposed at the threaded stud 4 includes two tangentially running slots 101, 102 at two oppositely disposed sides (compare FIG. 11). The two parallel arms 7, 8 of a bow spring 9 engage these slots. The bow spring 9 is fixed to a base plate 10 of a support frame 11 at the side disposed toward the actuating front attachment 3. A snap attachment of the support frame 11 at the actuating front piece 3 is provided by the engagement of the bow spring 9 into the tangential slots at the junction piece of the threaded stud 4. This snap-in attachment is assured against rotation based on the parallel direction of the arms 7, 8 and based on the tangential slots 101. 102. The support frame 11 is preferably produced from plastic and is provided with two parallel outside walls 12, 13 located at oppositely disposed sides of the rectangular base plate. Spring tongues 14 formed from a uniform material are provided at the two other oppositely disposed sides of the rectangular base plate 10 of the support frame 11. The spring tongues 14 are disposed such that they extend just as far in the direction opposite to the actuating front attachment 3 as do the outside walls 12, 13. Three spring tongues 14 are disposed in parallel to each other at a distance on each of the two sides of the base plate 10 and in fact such that two spring tongues 14 disposed oppositely to each other on the two sides are located in a plane parallel to the outside walls 12, 13.

The two outer walls, 12, 13 and the total six of the spring tongues 14 thus surround an inner space 15 disposed remote from the actuating front piece 3. The inner space 15 is limited at the top in the attachment region of the actuating front piece 3 by the base plate 10. A key switch element 16 disposed in the inner space 15 is demountably attached at the spring tongues 14. The key switching elements 16 have in addition two support webs 17, 18 protruding into the inner space 15. A free space exists between the two protruding support webs 17, 18. The ram 20 of a microswitch 22 or the like is disposed in the insulating casing 21 of the key switching element 16. The ram 20 protrudes at the base 19 of the said free space. Engagement recess beads 23 are formed at oppositely disposed outer sides of the support web 17, 18, which snap-in recess beads engage the snap-in noses 24. The snap-in noses 24 are formed at the three end regions of the spring tongues 14. In addition, insertion bevels 25 are formed at the narrow outside walls of the support webs 17, 18, which bevels run with increasing size from the three ends of the support webs 17, 18 in the direction toward the snap-in recess beads 23. The insertion bevels 25 allow an easy force guided clipping of the key switching element 16 at the support frame 11, whereby upon insertion of the support webs 17, 18 into the inner space 15 the spring tongues 14 spread apart easily and snap in in the end position with the snap-in noses 24 into the snap-in recess beads 23. In order to disengage the key switching element 16, it is only required that one of the spring tongues 14 is lifted to some extent such that the snap-in nose 24 is lifted out of the snap-in recess bead 23, and the key switching element 16 is withdrawn from the inner space 15. Thus always a quick and simple mounting as well as demounting of the parts is possible without special tools.

A transmission arrangement 26 is disposed in the immediate plane below the bow spring 9 at the inner side of the base plate 10 in the inner space 15. The transmission arrangement 26 is disposed between the two parallel attachment walls 27, 28 of the support frame 11. The attachment walls 27, 28 are located parallel to the two spring tongue rows and extend from the one outside wall 12 to the other outside wall 13. The complete support frame 11 is provided of a uniform material with its outside walls 12, 13, the spring tongues 14, the base plate 10 and the attachment walls 27, 28, and it is provided as a single piece. The transmission means 26 is provided with a base body 29 and guide frame 30. The base body 29 is disposed in the plane at the inner face of the base plate 10 and also in the region of a hole 31 formed in the base plate 10 for the pressure pin 6 of the actuating front attachment 3. The guide frame 30 is shaped substantially like a U, and it is snapped in with its side walls 32, at which clip noses 33 are formed, at the inside of the attachment walls 27, 28. The bottom wall 34 of the guide frame 30 is provided with three break-outs 35 formed at a distance next to each other. The break-outs 35 are located coaxially relative to the rams 20 of the key switch element 16.

Guide sleeves 36 are formed at the base body 29 coaxially relative to the break-outs 35 of the guide frame 30. The three guide sleeves 36 are disposed at a distance next to each other and have axial pins 37 disposed in their center axis. The axial pins are also formed at the base body 29. The guide sleeves 36 in addition have inwardly protruding stop edges 38 at their edge region disposed toward the lower wall 34 of the guide frame 30.

Thrust journals are disposed independently of each other inside of the transmission arrangement 26. The thrust journals 39 are substantially formed as a pot. In each case, an overthrow spring 43 is disposed in the pot space 43 of the thurst journal 39 surrounded by the pot wall 40 and the pot wall 41. The overthrow switch 43 is provided in the instant case at a helical compression spring. The overthrow springs 43 are supported at their upper end at the base body 29, and they are centered at the axial pin 37 engaging an overthrow spring 43. The lower end of the overthrow spring 43 presses against the bottom wall 41 of the thrust journal 39. In addition, protrusions 44 are formed at the upper edge region of the pot wall disposed remote relative to the bottom wall 41. The protrusions snap over the stop edges 38 of the guide sleeves 36 such that the thrust journals 39 cannot be passed out of the guide sleeves 36 in rearward direction despite the force of the overthrow springs 43. However in the upper direction, they can recede against the force of the overthrow springs 43 such that the thrust journals 39 can be telescoped individually in the axial direction of the ram 20. The thrust journals 39 are retained in a manner like that of a side catch lock in the guide sleeves 36, and they can be inserted or, respectively, exchangedrapidly by hand without problem. The thrust journals 39 penetrate the break-outs 35 in the bottom wall of the guide frame 30, and the outside surface of the bottom wall 41 presses against the ram 20 of the key switching element 16 in each case.

Furthermore, it can be recognized from the drawing that the base body 29 of the transmission arrangement 26 is provided with a recesss 45 versus the center guide sleeve 36. The recess 45 is directed toward the pressure pin 6 of the actuating front attachment 3. In addition, a main compression spring 46 is disposed in the transmission means 26. The main compression spring 46 is supported on the one side at the bottom wall 34 of the guide frame 30 and at its other end at the center guide sleeve 36 of the base body 29 disposed between the outer guide sleeves 36 in a centered position.

Figure 2:
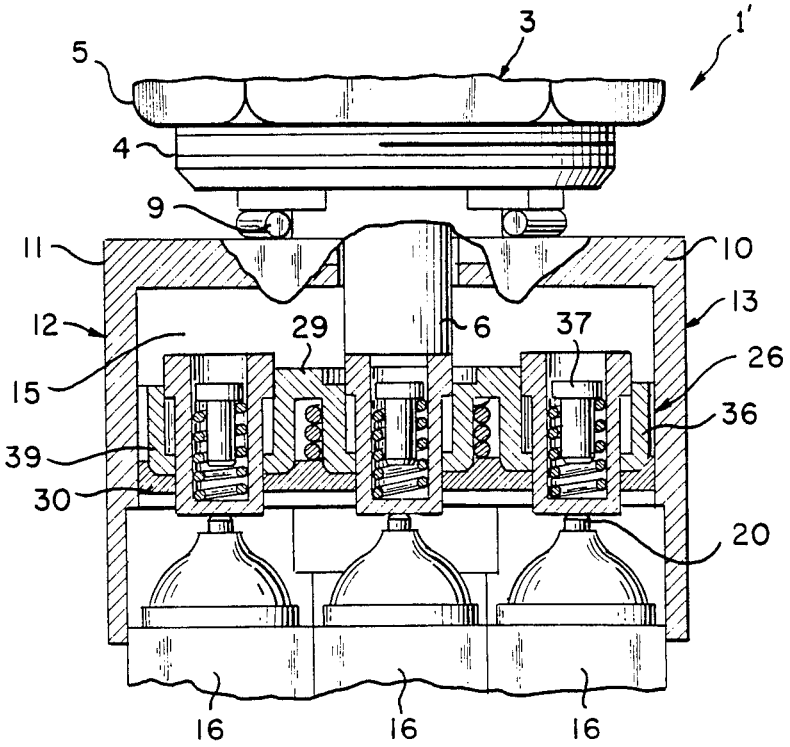
FIG. 2 is a partial sectional view of an electric switch similar to that of FIG. 1, however in the pressed in switching state.
Figure 9:
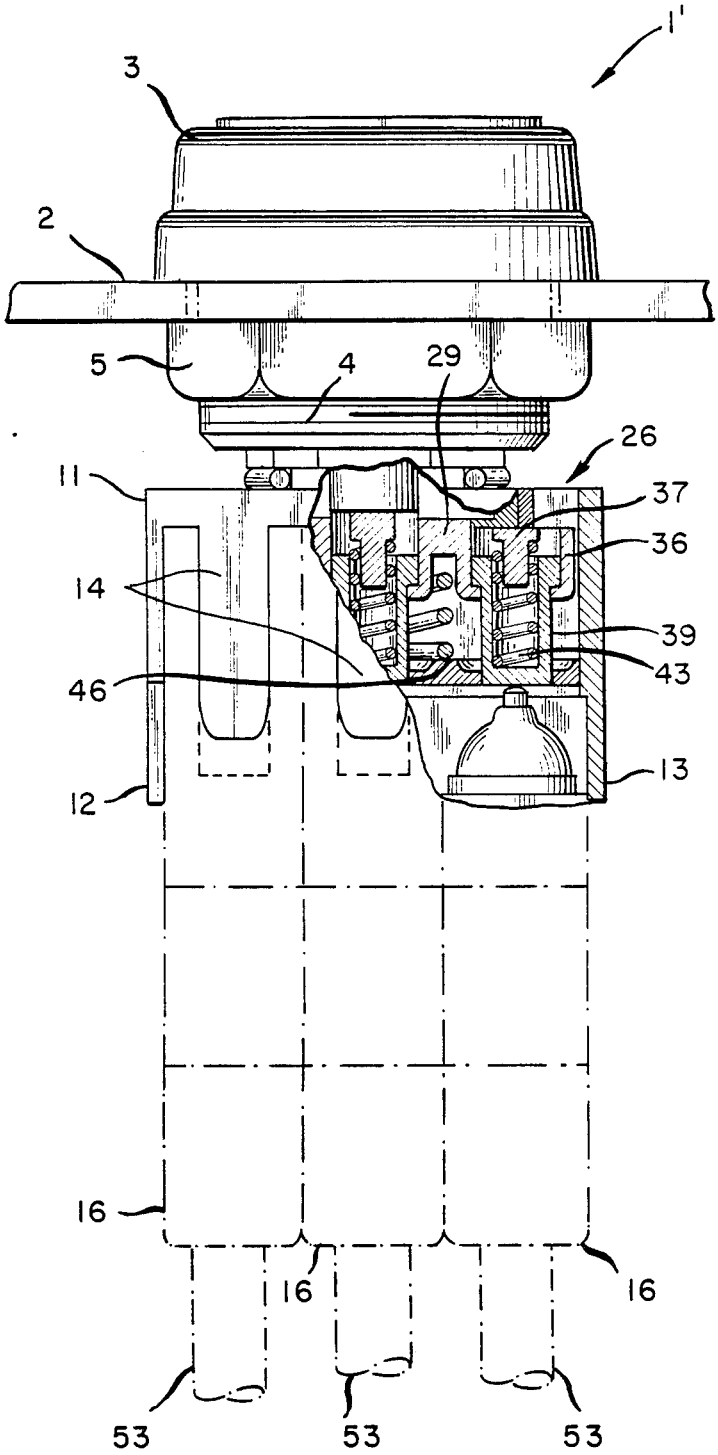
FIG. 9 is a partial sectional view of an electric switch according to the invention similar to that of FIG. 1 with in each case a connection line joined to the key switching elements.
Figure 10:
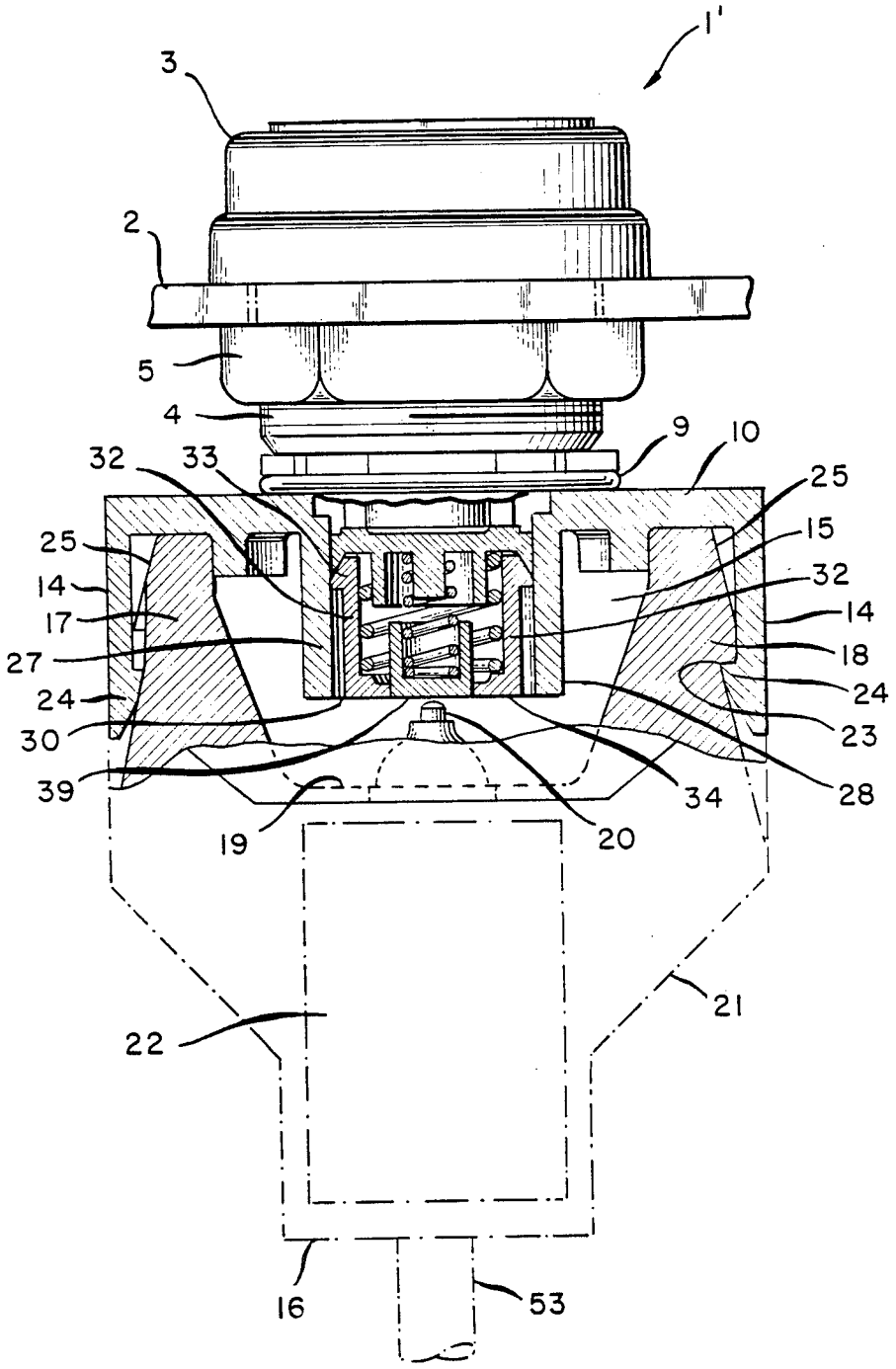
FIG. 10 is partially sectional side view of the the electric switch of FIG. 9.
Figure 11:
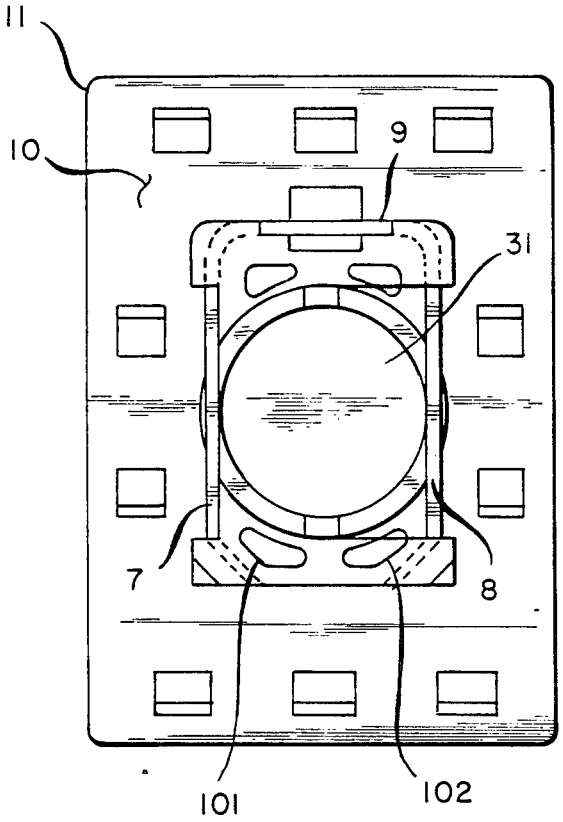
FIG. 11 is a plan view onto the support frame of the electronic switch of FIG. 9.

The embodiments of FIGS. 1 and 2 as well as of FIG. 9 and 10 illustrate the thrust journals 39, all of the same length, which thrust journals are disposed in a row next to each other at a distance. It follows from this that bottom walls 41 of the three thrust journals 39 are all in a single plane. In the case of a shifting and moving of the pressure pin 6 of the actuating front attachment 3 in the direction against the key switching elements 16, all rams 20 are pressed via the telescopable thrust journals 39 simultaneously downward into the switching position (FIG. 2).

Figure 5:
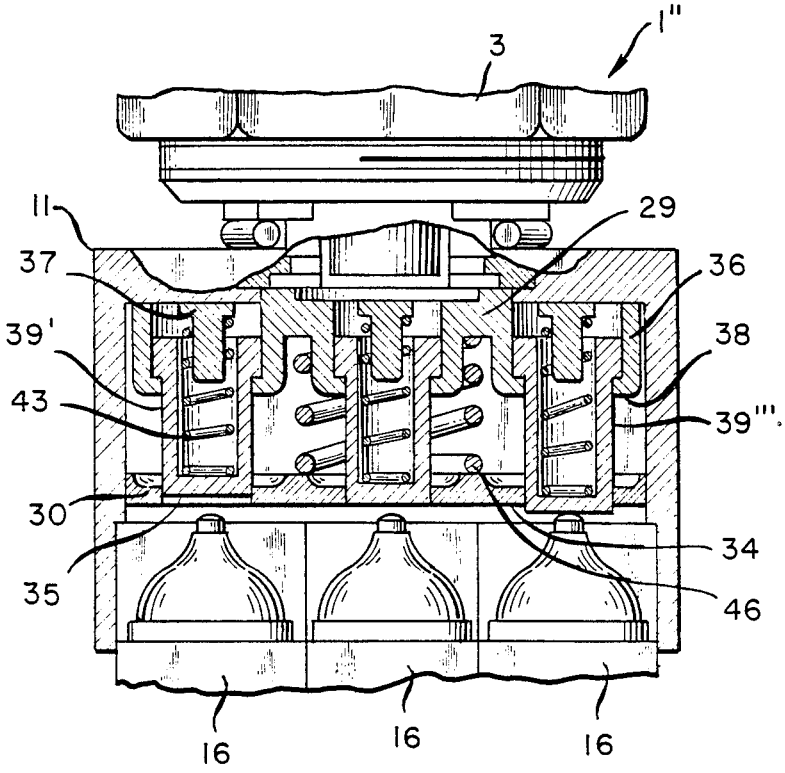
FIG. 5 is a partial sectional view of a further electronic switch according to the invention with three, of different lengths, telescopable thrust journals in rest position.
Figure 6:
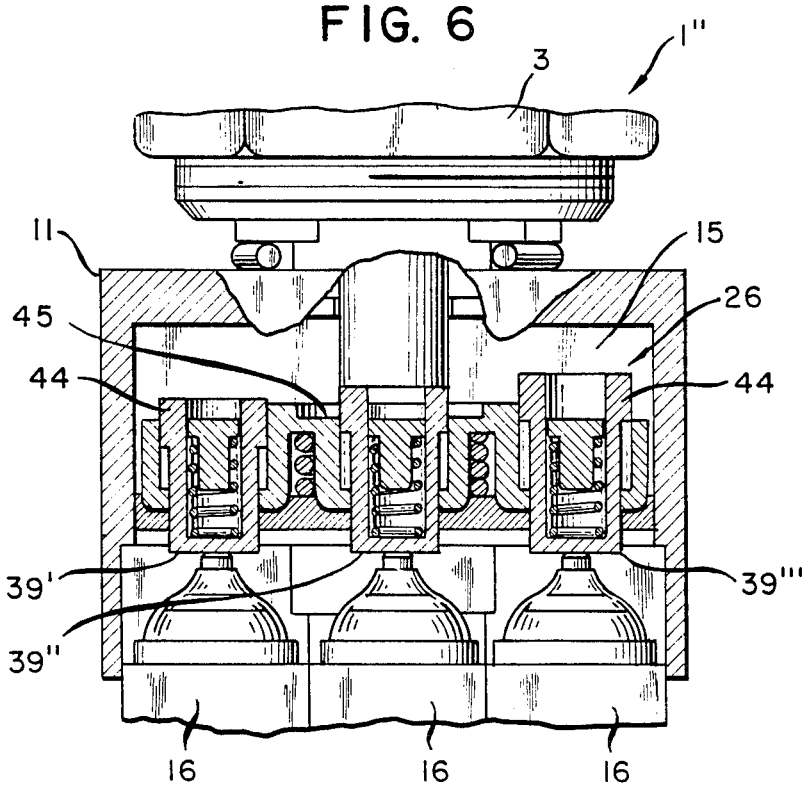
FIG. 6 is a partial sectional view similar to that of FIG. 5, where, however, the thrust in journals are located in the pressed in switching state.

It can be recognized from FIGS. 5 and 6 that the electric switch 1'' of this embodiment is provided with three thrust journals 39', 39'' and 39''' disposed next to each other. The axial length of the three thrust journals 39', 39'', 39''' are different. The thrust journal 39' illustrated on the left in the drawing is the shortest. The center thrust journal 39'' is provided with a regular, average length, while the right thrust journal 39''' exhibits the longest length such that its bottom wall is closest to the ram. In the case of a driving out of the pressure pin 6 of the actuating front attachment 3, for initiating a pressed down switching state (FIG. 6), initially the ram 20 of the right key switch element 16 is moved. Then the pressing in of the center ram 20 by the thrust journal 39'' occurs and finally the ram 20 of the left key switch element is actuated with the left thrust journal 39' such that at this electro-switch 1', a time staggered successive switching of the three key switch elements 16 is performed by a single actuating pulse at the actuating front attachment 3. Of course, it is within the framework of the invention to set the different lengths of thrust journals 39', 39'', 39''' at the transmission arrangement 26 in a different sequence and/or to make the differences of these thrust journal lengths larger or smaller.

Figure 3:
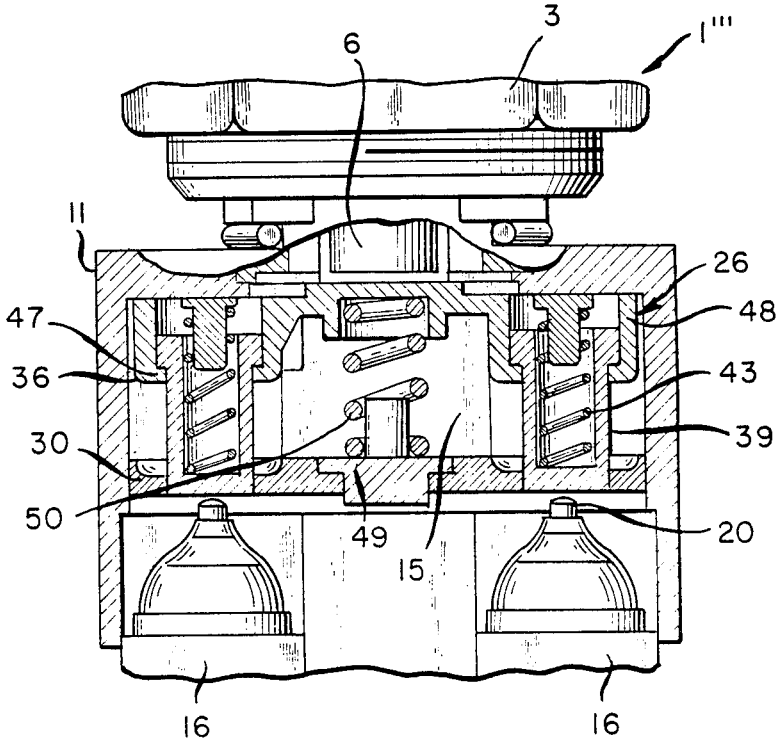
FIG. 3 is a partial sectional view of a further invention electric switch with two equally formed, telescopable thrust journals in rest position.
Figure 4:
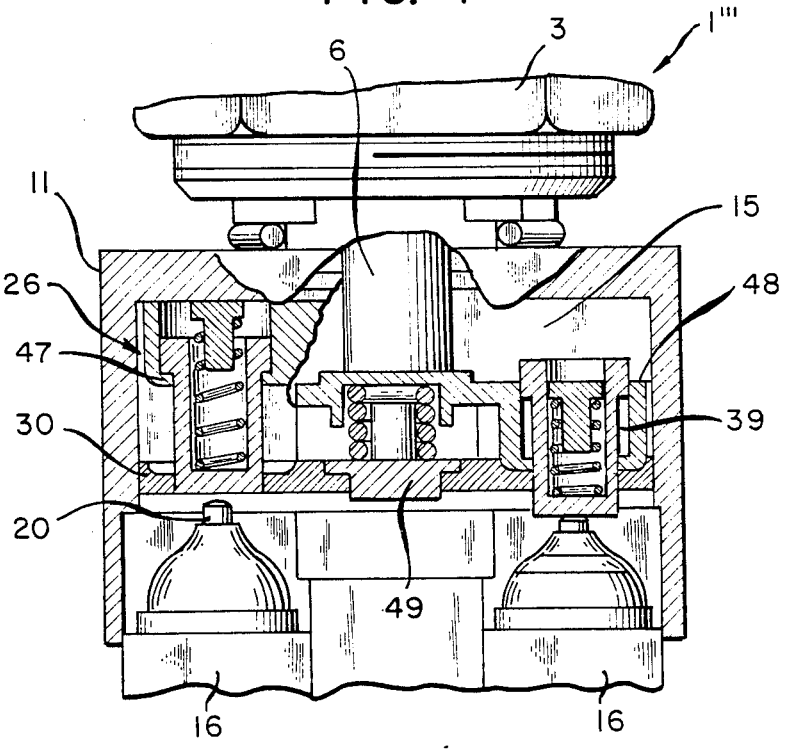
FIG. 4 is a partial sectional view similar to that of FIG. 3, however where the thrust journals are located in the pressed in switching state.

Only two outer key switch elements 16 are provided in the embodiment of FIGS. 3 and 4, such that in the transmission means 26 also only two outer thrust journals 39 are disposed in the guide sleeves 36. The two thrust journals 39 are in the instant case of equal length. The base body 29 is separated about in its middle region such that two base body parts 47, 48 are formed, of which one of each is provided with one of the the two guide sleeves 36. Two individual compression springs 50 are supported at one center pin 49 disposed in the bottom wall 34 of the support frame 30. In each case, one of the individual compression springs 50 is coordinated to one of the two base body parts 47, 48. FIG. 4 illustrates that upon moving out of the pressure pin 6 thus actuating of the actuating front piece 3, only in each case one of the two base body part 47, 48 is pressed down depending upon which switching process is initiated at the actuating front piece 3.

According to the present embodiment, the right base body part 47 has been pressed down such that the ram 20 of the right hand key switch element 16 is actuated via the right hand thrust journal 39.

Figure 7:
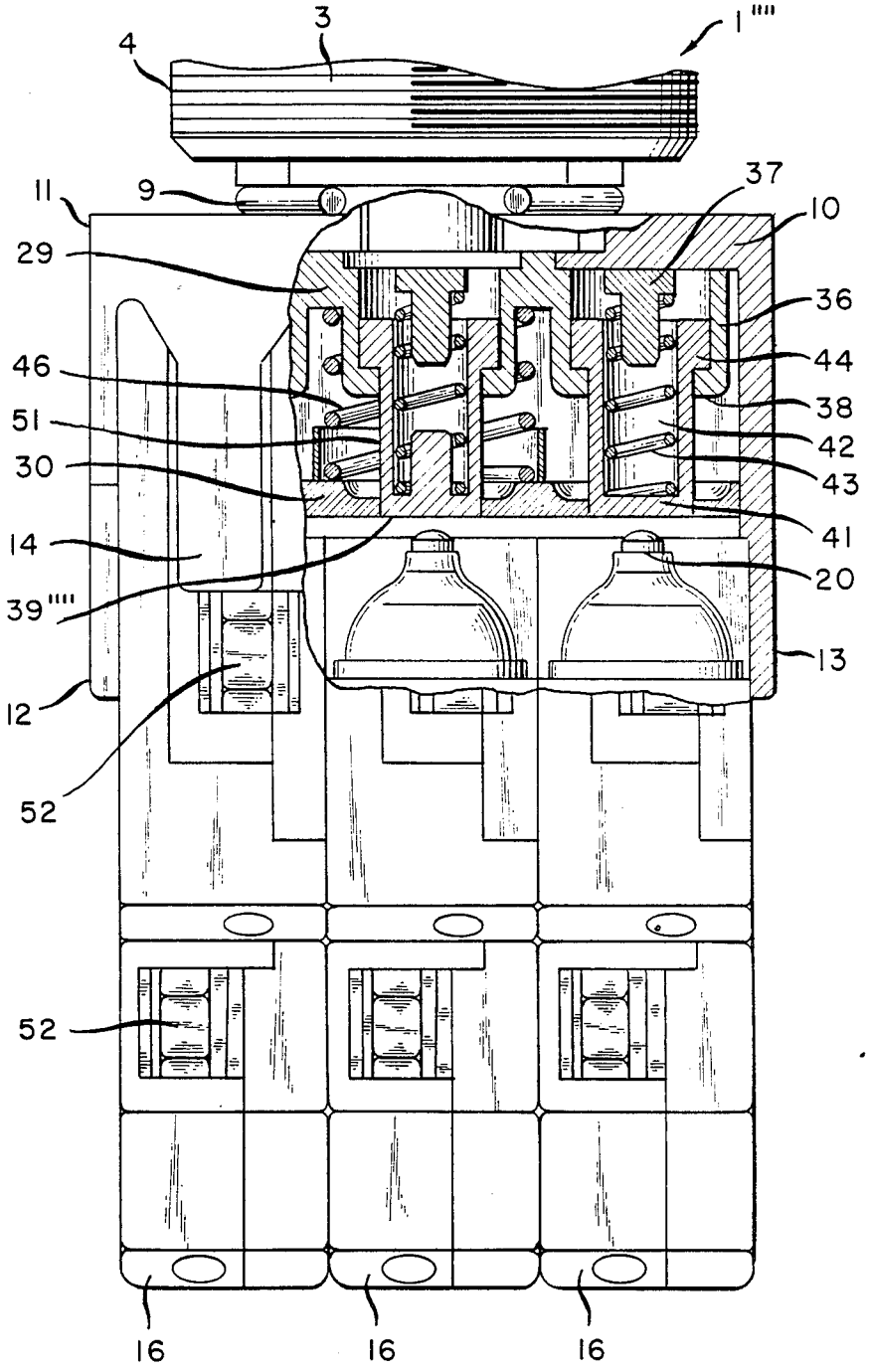
FIG. 7 is an enlarged partial sectional view of a further electric switch according to the invention in rest state with a center thrust journal opening by force independent of the spring force.
Figure 8:
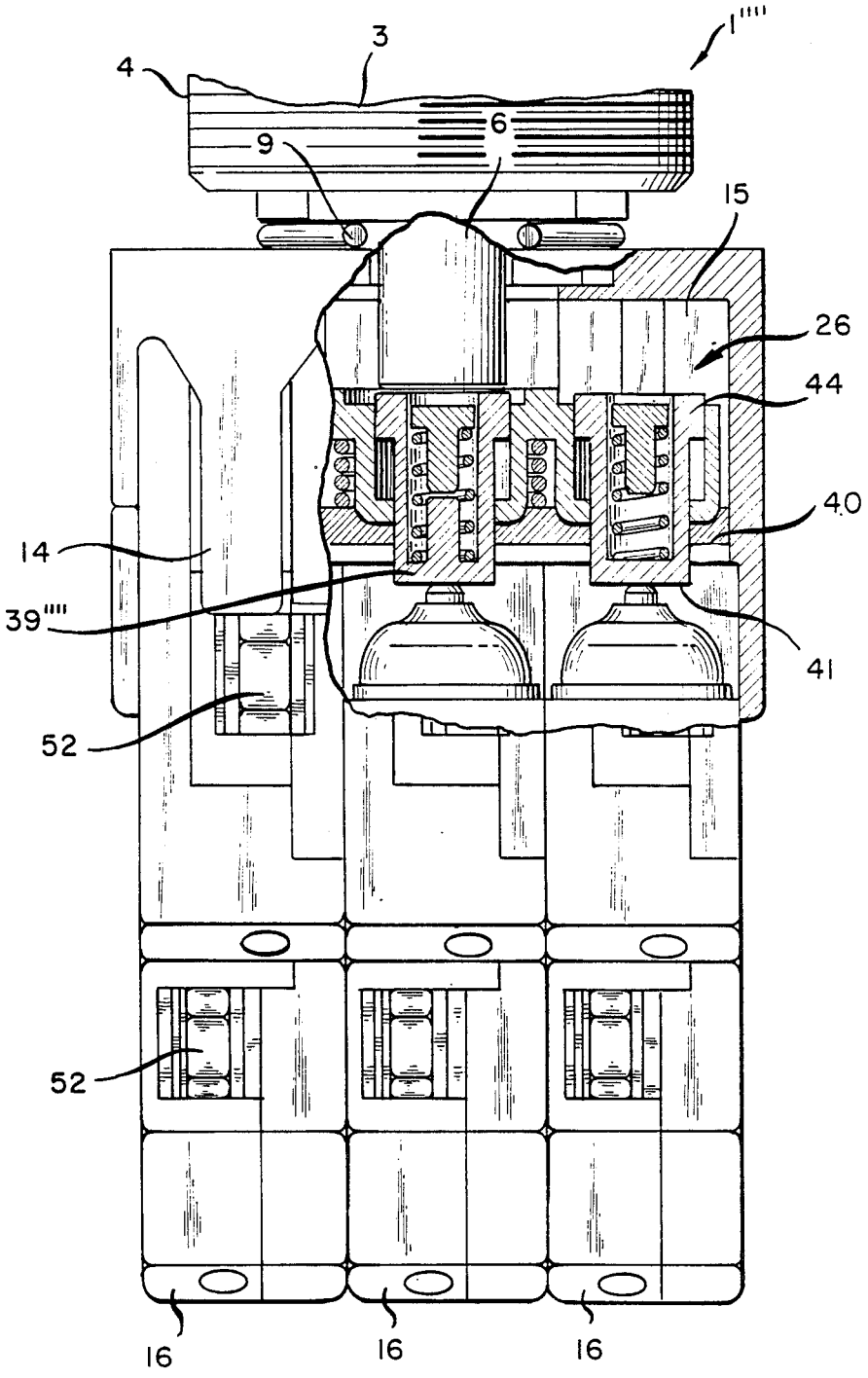
FIG. 8 is a partial sectional view similar to that of FIG. 7, however in the pressed-in switching state.

It can be recognized from FIGS. 7 and 8 that the center thrust journal 39'''' of the electronic switch 1 is provided with a stop pin 51 which is formed at the bottom wall 41 and which extends in axial direction within the pot space 42 upwardly in the direction of the axial pin 37. The stop pin 51 engages the overthrow spring 43. In the pressed switching state as illustrated in FIG. 8, the stop pin 51 and the axial pin 37 push and butt against each other such that thereby a rigid pressure switch motion is generated. It is possible based on this mechanical stop that the switching contacts in the microswitch 22 of the key switch element 16 are opened by force. Thus mechanical ripping open of the switching contacts is provided. The spring loaded intermediate member in the center thrust journal 39'''' thus is here provided smaller than at the other thrust journals 39 and there further exists the possibility to dispense intentionally and completely with a spring loaded intermediate member for the forced switching opening.

Advantageous possiblities for various individual actuations are provided according to the invention in the case of the electric switch 1 with individually disposed independent thrust journals 39. Thus with this device, different switching sequences or, respectively, switching processes can be performed by advancing or following contact switches. The embodiments of FIGS. 7 and 8 provide the key switching elements 16 with connecting terminal clamps 52 accessible from the narrow outsides, and electrical conduits can be connected terminal to these connecting clamps 52. Each key switching element 16 is provided in this case at each of the two oppositely disposed narrow outsides with two in each case on top of each other disposed connecting clamp terminals 52 which are disposed somewhat staggered with respect to each other in the illustrated vertical plane.

The key switch elements 16 are provided with a connecting line 53 according to the embodiment of FIGS. 9 and 10. The connecting lines 53 run to the microswitch 22 and advantageously they canb e cast with casting resin in the insulating casing 21 instead. Instead of a single connecting line 53, it is also possible to provide several such as for example four individual connecting wires at the key switch element 16 and to run them to the microswitch 22. These individual connecting wires can also advantageously be closed in a sealing way in the insulating casing 21 of the key switching element 16 with a casting resin.

It will be understood that each of the elements described above, or two or more together, may also find a useful application in other types of control system configurations and electric switching procedures differing from the types described above.

While the invention has been illustrated and described as embodied in the context of an electric switch, it is not intended to be limited to the details shown, since various modifications and structural changes may be made without departing in any way from the spirit of the present invention.

Without further analysis, the foregoing will so fully reveal the gist of the present inention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An electric switch comprising a support frame;
key switching elements disposed in an inner space of the support frame and individually attachable to the support frame;
a pressure pin;
a compression spring;
a base body movable by the pressure pin against the force of the compression spring;
a bow spring;
an actuating front attachment mountable to a front plate and supported by the bow spring where the bow spring contacts the front plate;
two telescoping thrust journals supported by the base body;
two overthrow springs individually disposed at a corresponding thrust journal;
rams associated to the key switching elements and coordinated to the corresponding telescoping thrust journal via the overthrow springs; and
transmission means disposed in the inner space of the support frame below the plane of the bow spring and between a pressure pin of the actuating front attachment and the rams of the key switching elements, where the two thrust journals are joined to the transmission means.

2. The electric switch according to claim 1 further comprising
a guide frame supporting the base body with the telescopic thrust journals, where a bottom wall of the guide frame is provided with break-outs for thrust journals movable against the rams and where side walls of the guide frame are snapped in with clip noses between attachment walls in the inner space of the support frame.

3. The electric switch according to claim 1
wherein the thrust journals of the transmission means are formed substantially like a pot, where such pots are disposed side by side and where the overthrow springs are supported in the pot spaces of the thrust journals and the overthrow springs are supported at the bottom walls of the thrust journals.

4. The electric switch according to claim 1 wherein the transmission means further comprises guide sleeves formed with the base body substantially as a single piece for axially slidably supporting the thrust journals of the transmission means with pot wall parts and where the thrust journals grip over stop edges of the guide sleeves with protrusions formed at the edge regions of the pot wall disposed relatively remote from the floor wall.

5. The electric switch according to claim 1 wherein the overthrow springs of the thrust journals are centeredly supported at axle journals of the guide sleeves based on a protruding of the thrust journals into the overthrow springs.

6. The electric switch according to claim 1 wherein the lengths of the thrust journals disposed at a distance next to each other at the base body are equal for parallel actuation of the rams of the key switching elements disposed in a plane.

7. The electric switch according to claim 1 wherein the lengths of the thrust journals disposed at a distance next to each other at the base body are different for sequential actuation of the rams of the key switching elements disposed in a plane.

8. The electric switch according to claim 1 wherein the compression spring of the transmission means is centeredly supported against the bottom wall of the guide frame at the middle guide sleeve of the base body between two side guide sleeves.

9. The electric switch according to claim 1 wherein the base body of the transmission means is provided with two base body parts separated from each other with at least a guide sleeve with a coordinated thrust journal disposed at a respective base body part and where each of the two parts of the base body has coordinated an individual compression spring supported at a central pin of the guide frame.

10. The electric switch according to claim 4 wherein the thrust journal is furnished with a stop pin extending from the bottom wall in the direction to the axle pin of the guide sleeve to provide a force independent forced switching via the ram of the key switching element.

11. The electric switch according to claim 4 wherein the base body is provided with a recess at the side opposite to the middle guide sleeve and disposed toward the pressure pin of the actuating front attachment.

12. The electric switch according to claim 1 wherein the guide sleeves of the base body are disposed at a distance next to each other and are located in a plane between two spring tongues of the support frame with the thrust journals and where in each case a key switching element with snap-in noses engages into snap-in beads at two outside surfaces of the key switching element.

13. The electric switch according to claim 1 wherein the key switching elements are provided with inclined running insertion bevels relative to the axis of the thrust journal and are at the outside surfaces of the key switching elements furnished with the snap-in beads, which insertion bevels are covered by the spring tongues of the support frame.

* * * * *